US010180255B2

(12) United States Patent
Nakata

(10) Patent No.: US 10,180,255 B2
(45) Date of Patent: Jan. 15, 2019

(54) COMBUSTION CONTROLLING DEVICE AND COMBUSTION SYSTEM

(71) Applicant: Azbil Corporation, Tokyo (JP)

(72) Inventor: Tomoya Nakata, Tokyo (JP)

(73) Assignee: Azbil Corporation, Tokyo (JP)

( * ) Notice: Subject to any disclaimer, the term of this patent is extended or adjusted under 35 U.S.C. 154(b) by 365 days.

(21) Appl. No.: 15/098,946

(22) Filed: Apr. 14, 2016

(65) Prior Publication Data

US 2016/0305662 A1 Oct. 20, 2016

(30) Foreign Application Priority Data

Apr. 17, 2015 (JP) ..... 2015-084775

(51) Int. Cl.

*F23Q 9/00* (2006.01)
*F23N 3/00* (2006.01)
*F23C 3/00* (2006.01)

(52) U.S. Cl.

CPC ..... *F23N 3/002* (2013.01); *F23C 3/002* (2013.01); *F23N 3/00* (2013.01); *F23D 2209/30* (2013.01);

(Continued)

(58) Field of Classification Search

CPC ..... F23N 3/002; F23N 3/00; F23N 2037/02; F23N 2027/02; F23N 2027/04; F23C 3/002; F23D 2209/30

See application file for complete search history.

(56) References Cited

U.S. PATENT DOCUMENTS 5,271,556 A * 12/1993 Helt ..... F23N 5/203 236/11

FOREIGN PATENT DOCUMENTS

CN 101117659 A 2/2008
JP H11-037460 2/1999

(Continued)

OTHER PUBLICATIONS

The State Intellectual Property Office of People's Republic of China, "Office Action", issued in Chinese Patent Application No. 201610236615.3, which is a CN counterpart of U.S. Appl. No. 15/098,946, dated Feb. 14, 2018, 11 pages (5 pages of English Translation of Office Action and 6 pages of Office Action).

(Continued)

*Primary Examiner* — Alfred Basichas

(74) *Attorney, Agent, or Firm* — Amster, Rothstein & Ebenstein LLP

(57) ABSTRACT

A purge time of a combustion space is optimized in a multi-burner system having a combustion chamber in which the combustion space is physically separated from a heating space by providing a combustion controlling device. The combustion controlling device controls an operation of multiple burners having combustion spaces different from each other, a first prepurge time and a second prepurge time set as execution times of a single purge, the single purge based on the first prepurge time is performed on a combustion space of a corresponding burner after overall purge when an ignition of the burner is instructed in a state where none of the burners is ignited, and the single purge based on the second prepurge time is performed on the combustion space of the corresponding burner when the ignition of the burner is instructed in a normal operating state.

5 Claims, 4 Drawing Sheets

(52) U.S. Cl.
CPC ..... *F23N 2027/02* (2013.01); *F23N 2027/04* (2013.01); *F23N 2037/02* (2013.01)

(56) References Cited

FOREIGN PATENT DOCUMENTS

| | | | |
|---|---|---|---|
| JP | 2000-039142 | A | 2/2000 |
| JP | 2000-297928 | A | 10/2000 |

OTHER PUBLICATIONS

Japanese Application No. 2015-084775, filed Apr. 17, 2015.
Korean Intellectual Property Office, "Office Action", issued in Korean Patent Application No. 10-2016-0045565 which is a KR counterpart of U.S. Appl. No. 15/098,946, dated Sep. 16, 2017, 8 pages (4 pages of English Translation of Office Action and 4 pages of Office Action).

* cited by examiner

COMBUSTION CONTROLLING DEVICE AND COMBUSTION SYSTEM

CROSS-REFERENCE TO RELATED APPLICATION

This application claims the benefit of and priority to Japanese Patent Application No. 2015-084775, filed on Apr. 17, 2015, the entire contents of which are incorporated herein by reference.

TECHNICAL FIELD

The present invention relates to a combustion controlling device and a combustion system, and more particularly to a combustion controlling device that controls a combustion system having multiple combustion spaces in which flames are generated.

BACKGROUND ART

In general, in combustion furnaces (combustion systems) typified by industrial furnaces such as a steel furnace, a heating furnace and a deodorizing furnace, a combustion control is performed by a combustion controlling device while monitoring a combustion state of a burner disposed in the combustion furnace, a furnace temperature, a pressure of a combustion air, and a pressure of a fuel to be supplied to the burner, to thereby ensure safe combustion. For example, in order to prevent the explosion of the combustion furnace, the combustion controlling device executes an ignition of the burner after performing purge (prepurge) for discharging a residual fuel (gas) in the combustion furnace to an outside of the combustion furnace at the time of igniting the burner, determines whether the burner is ignited, or not, with the use of a flame detector, and performs a safety control for stopping the supply of the fuel to the combustion furnace when the burner is not ignited (for example, refer to Patent Document 1).

PRIOR ART DOCUMENTS

Patent Documents

[Patent Document 1] JPA-11-37460

SUMMARY OF THE INVENTION

Problems to be Solved by the Invention

Incidentally, in combustion systems having multiple burners (multi-burner systems), multiple burners are installed in a common combustion chamber (zone). In the present specification, the combustion chamber means a space in which combustion is controlled under a condition (parameter) where a temperature or a pressure is the same, and is also called "zone" below.

Most of the multi-burner systems include burner controllers that are installed in the respective burners, and control the ignition of the respective burners, and a safety controlling device that controls those burner controllers to control the combustion of the overall combustion chamber.

In the multi-burner systems of this type, it is general to perform the purge (prepurge) on a combustion chamber basis by the safety controlling device. For example, at the time of a startup (hereinafter called "initial startup") for igniting a desired burner from a state in which none of the burners is ignited, the safety controlling device first prepurges the overall combustion chamber. Thereafter, the safety controlling device gives an ignition instruction to a desired burner controller whereby the burner controller executes an ignition sequence control to ignite a corresponding burner.

On the contrary, in a multi-burner system having a combustion chamber where a combustion space in which a flame is generated is physically separated from a heating space in which an object to be heated is placed, as in a multi-burner system using radiant tube burners, not only purge (hereinafter called "overall purge") on the combustion chamber basis for discharging the residual fuel in the multiple combustion spaces all at once, but also purge (hereinafter called "single purge") on a combustion space basis for discharging the residual fuel in the respective combustion spaces, individually, may be required.

For example, let us consider a case where, in a situation in which a flame fails in one of the multiple combusting burners, the burner subjected to the flame failure is reignited. In that case, in the multi-burner system using the radiant tube burners, even in a situation where another burner in the combustion chamber is combusted, because the combustion spaces of the respective burners are separated from each other, there is a need to ignite a burner to be reignited after the combustion space of the burner in question is prepurged. In the multi-burner system using no radiant tube burner described above, since another burner is combusted in the combustion chamber, the burner subjected to the frame failure can be reignited without prepurging the overall combustion chamber (overall purge) (for example, JIS B 8415, etc.).

As described above, in the multi-burner system using the radiant tube burners, there is a case in which the prepurge on the combustion space basis is required. For that reason, in the conventional multi-burner system using the radiant tube burners, a process for performing a single purge is incorporated into an ignition sequence of each burner controller, separately from the overall purge performed by the safety controlling device. As a result, even in the case where the radiant tube burners are reignited, individually, only the combustion space of the burner to be reignited can be prepurged without purging the overall combustion spaces including the combustion space of the combusting burner.

However, the above multi-burner system using the radiant tube burners suffers from such a problem that because the ignition sequence control is executed by each burner controller after the overall purge has been performed by the safety controlling device at the initial startup, a purge time of the overall purge and a purge time of the single purge in the ignition sequence control are added together, the overall prepurge time becomes long during the initial startup, and igniting the burner takes time.

An object of the present invention is to optimize a purge time of a combustion space in a multi-burner system having a combustion chamber in which the combustion space is physically separated from a heating space.

Means for Solving the Problems

According to the present invention, there is provided a combustion controlling device (1) that controls the operation of N (N is an integer of 2 or more) number of burners (22A to 22C) having respective combustion spaces (21A to 21C) different from each other, the combustion controlling device including: burner controllers (11A to 11C) that are disposed for the respective burners, and control ignition of the respective burners and purge of the combustion spaces of the respective burners; and an instruction portion (102) that instructs the burner controllers to execute the purge of the respective combustion spaces and to ignite the respective burners, wherein the instruction portion instructs the respective burner controllers to purge the combustion spaces, and instructs the respective burner controllers to ignite M (M is an integer of $1 \leq M \leq N$) number of burners after the purge has been completed when the M number of burners are ignited from a state in which none of the N number of burners is ignited, and instructs the corresponding burner controller to ignite an arbitrary burner without giving an instruction to purge the corresponding combustion space when the arbitrary burner is ignited in a normal operating state after the M number of burners have been normally ignited, and the burner controllers start ignition operation of the respective burners a first prepurge time (T1) after supplying air to the combustion spaces of the respective burners in a state of stopping the supply of fuel to the combustion spaces when the burner controllers are instructed to ignite the respective burners from the instruction portion in a state where none of the burners is ignited, and start the ignition operation of the respective burners a second prepurge time (T2) after supplying the air to the combustion spaces of the respective burners in a state of stopping the supply of fuel to the combustion spaces when the burner controllers are instructed to ignite the respective burners from the instruction portion in the normal operating state.

In the above combustion controlling device, the first prepurge time (T1) may be less than the second prepurge time (T2).

In the above combustion controlling device, the first prepurge time may be 0 seconds.

The above combustion controlling device may further include an operation mode setting portion (101) that sets any one of an initial startup mode for igniting the M number of burners from the state in which none of the N number of burners is ignited, and a normal operation mode for controlling the operation of the N number of burners in the normal operating state after the M number of burners have been normally ignited as an operation mode, in which each of the burner controllers may include a purge controlling portion (114) that controls the purge of the combustion space of the corresponding burner according to an instruction for execution of the purge by the instruction portion, an ignition controlling portion (115) that controls the ignition of the corresponding burner, a purge time setting portion (111) that sets an execution time of the prepurge to a first prepurge time when the initial startup mode is set by the operation mode setting portion, and sets the execution time of the prepurge to a second prepurge time when the normal operation mode is set by the operation mode setting portion, and an ignition sequence controlling portion (112) that instructs the corresponding purge controlling portion to execute the prepurge on the basis of the execution time of the prepurge set by the purge time setting portion, and instructs the corresponding ignition controlling portion to ignite the burner, according to an instruction for igniting the burner by the instruction portion.

In the combustion controlling device, the operation mode setting portion may switch the operation mode from the initial startup mode to the normal operation mode when the M number of burners are normally ignited in the initial startup mode.

A combustion system according to the present invention includes the above combustion controlling device; a combustion chamber (2) having N number of combustion spaces; first valves (41A to 41C) that are disposed in the respective combustion spaces, and control the supply of air to the respective combustion spaces on the basis of a control signal (24A to 24C) from the purge controlling portion; and second valves (31A to 31C) that are disposed in the respective combustion spaces, and control the supply of fuel to the burners of the respective combustion spaces on the basis of a control signal (25A to 25C) from the ignition controlling portion.

In the above combustion system, the burners may be radiant tube burners.

In the above description, as an example, components on the drawings corresponding to components of the present invention are represented by reference numerals in parentheses.

Advantage of the Invention

As described above, according to the present invention, a purge time of a combustion space can be optimized in a multi-burner system having a combustion chamber in which the combustion space is physically separated from a heating space.

MODE FOR CARRYING OUT THE INVENTION

Embodiments of the invention will be described below with reference to the drawings.

(Configuration of Combustion System)

Figure 1:
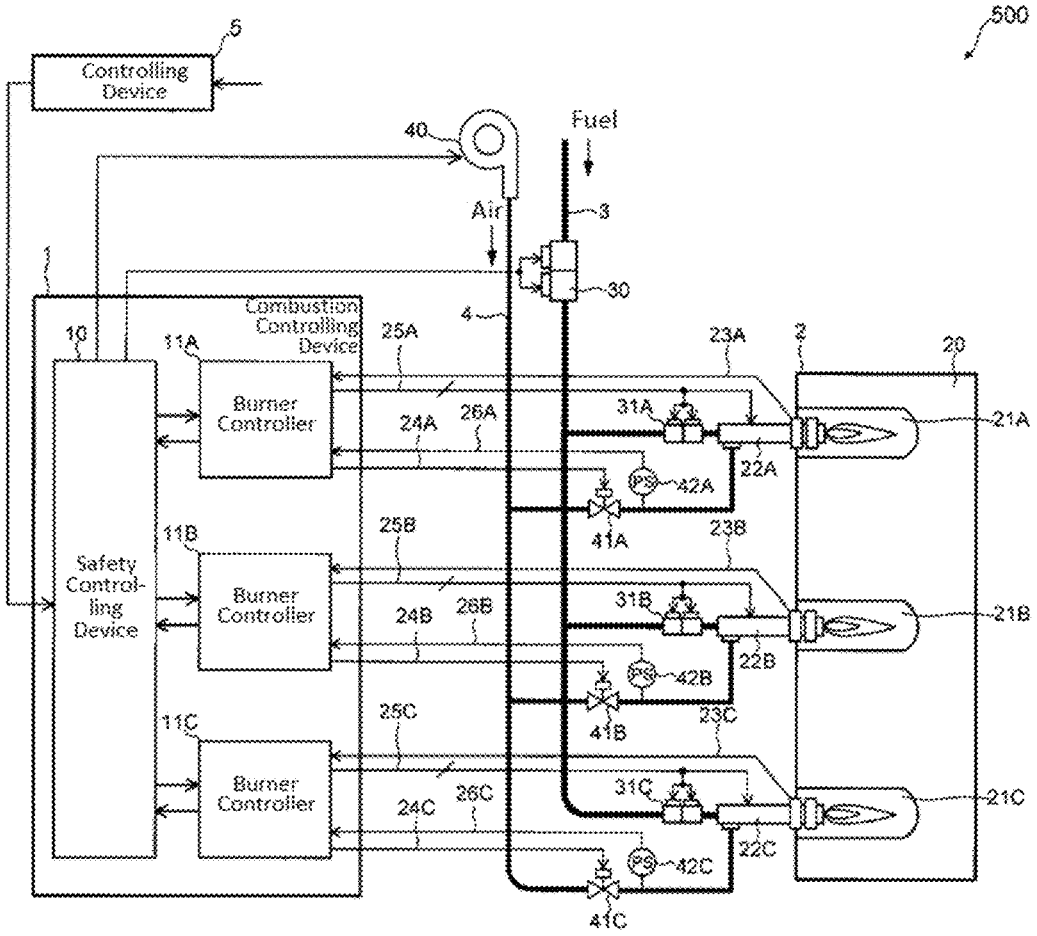
FIG. 1 is a diagram illustrating a configuration of a combustion system having a combustion controlling device according to the present embodiment.

FIG. 1 is a diagram illustrating a configuration of a combustion system having a combustion controlling device according to the present embodiment.

A combustion system 500 illustrated in the figure is a multi-burner system having a combustion chamber where multiple combustion spaces in which flames are generated by burners are physically separated from a heating space in which an object to be heated (hereinafter also referred to as "workpiece") is placed. The combustion system 500 can be exemplified by small industrial combustion furnaces such as a deodorizing furnace or a heating furnace, or large industrial combustion furnaces such as a steel furnace in a plant.

In the present specification, the combustion chamber (zone) means a space in which combustion is controlled under a condition (parameter) where a temperature or a pressure is the same as described above, and includes not only a structure in which the respective combustion chambers are physically separated from each other, but also a structure in which the respective combustion chambers are not physically separated from each other. Further, the workpiece can be exemplified by an object to be processed such as a material such as iron or aluminum, steel to be carburized, a vehicle body as an object to be dried, or ceramic to be burned.

Specifically, the combustion system 500 includes a combustion chamber 2, a combustion controlling device 1 that controls combustion of multiple burners placed in the combustion chamber 2, a fuel flow channel 3 for supplying fuel (gas) to the respective burners, an air flow channel 4 for supplying air to the combustion spaces of the respective burners, and a controlling device 5 that controls the combustion controlling device 1.

The combustion chamber 2 includes N (N is an integer of 2 or more) number of burners (main burners) having respective combustion spaces different from each other.

In the present embodiment, a description will be given of an example in which, as illustrated in FIG. 1, the combustion chamber 2 includes three (N=3) combustion spaces 21A, 21B, and 21C that are separated from each other, and a heating space 20 that is physically separated from the respective combustion spaces 21A to 21C, and burners 22A, 22B, and 22C as main burners are disposed in the respective combustion spaces 21A to 21C. The number of combustion spaces in the combustion chamber 2 and the number of burners placed in each of the combustion spaces are not particularly restricted. For example, four or more combustion spaces may be provided in the combustion chamber 2, and two or more burners may be disposed in each combustion space.

The burners 22A to 22C (collectively referred to as "burners 22") are devices that generate flames in the respective combustion spaces 21A to 21C (collectively referred to as "combustion spaces 21") to heat the workpiece placed in the heating space 20. The fuel (gas) used for combustion of the burners 22 located in the combustion spaces 21 is supplied to the combustion spaces 21. The gas different from the fuel to be supplied to the combustion spaces 21 and the air, which are used for heating the workpiece is supplied to the heating space 20.

The burners 22A to 22C are, for example, radiant tube burners. Flame detectors for detecting whether the flames of the respective burners 22 are present, or not, ignition devices (ignitors) for igniting the respective burners 22, and pilot burners are disposed in the periphery of the respective burners 22A to 22C. The ignition devices ignite the respective burners on the basis of control signals 25A to 25C from the combustion controlling device 1 which will be described later. Detection results (flame detection signals) 23A to 23C of whether the flames are present, or not, by the flame detectors are input to the combustion controlling device 1 to be described later. In FIG. 1, for convenience of the illustration, the unification of the burners, the flame detectors, the ignition devices, and the pilot burners are illustrated as the burners 22A, 22B, and 22C.

The fuel flow channel 3 is a flow channel for supplying the fuel (gas) to the respective combustion spaces 21A to 21C (burners 22A to 22C). The fuel flow channel 3 is branched into multiple flow channels from a main flow channel to which the fuel is supplied from the outside. The branched flow channels are connected to the respective burners 22A to 22C. As a result, the fuel to be supplied to the fuel flow channel 3 from the external are delivered to the respective burners 22A to 22C. A valve (safety shutoff valve) 30 is installed in the main flow channel of the fuel flow channel 3, and valves (safety shutoff valves) 31A to 31C are installed in the respective flow channels branched from the main flow channel of the fuel flow channel 3. The safety shutoff valve 30 is a main valve of the fuel flow channel 3, and the open/close of the valve is controlled by, for example, a safety controlling device 10 to be described later in the combustion controlling device 1. The open/close operation of the safety shutoff valves 31A to 31C (collectively referred to as "safety shutoff valves 31") is controlled according to control signals 25A to 25C from burner controllers 11A to 11C to be described later in the combustion controlling device 1, and the safety shutoff valves 31A to 31C control the supply of fuel to the respective burners 22A to 22C, and the shutoff of fuel.

The air flow channel 4 is a flow channel for supplying the air to the respective combustion spaces 21A to 21C. The air flow channel 4 is branched into the multiple flow channels from the main flow channel to which the air discharged from a blower 40 is supplied. The branched flow channels are connected to the respective burners 22A to 22C. As a result, the air discharged from the blower 40 is supplied to the respective burners 22A to 22C. The blower 40 may be driven by not only the safety controlling device 10, but also the controlling device 5.

Air valves (air electromagnetic valves) 41A to 41C and wind pressure switches 42A to 42C are installed in the respective flow channels branched from the main flow channel of the air flow channel 4. The open/close operation of the air valves 41A to 41C (collectively referred to as "air valves 41") is controlled according to control signals 24A to 24C from the burner controllers 11A to 11C to be described later in the combustion controlling device 1, and the air valves 41A to 41C control the supply and shutoff of the air to the respective burners 22A to 22C.

The wind pressure switches 42A to 42C (collectively referred to as "wind pressure switches 42" are elements for detecting the pressure of the air to be supplied to the respective burners 22A to 22C. Specifically, the wind pressure switches 42A to 42C each include a switch, a sensor that detects a pressure of the air in a corresponding branch flow channel of the air flow channel 3, and a switch driving portion that determines whether the air pressure detected by the corresponding sensor exceeds a predetermined set pressure value, or not, and controls the on/off operation of the switch according to a determination result. For example, the switch driving portion turns on the switch if the air pressure exceeds the set pressure value, and turns off the switch if the air pressure does not exceed the set pressure value. The information indicative of the on/off operation of the switch is input to, for example, the respective burner controllers 11A to 11C and the safety controlling device 10 as binary detection signals 26A to 26C.

The controlling device 5 is a device on a higher level side in the combustion system 500, for performing a comprehensive control of the combustion chamber 2. The controlling device 5 gives a combustion request for the respective burners in the combustion chamber 2 and a combustion stop request for each burner or all the burners in the combustion chamber 2 to the combustion controlling device 1 according to input operation from an operator (user) or the like.

The controlling device 5 may be a device for giving an instruction to the combustion controlling device 1 according to the user's operation. For example, the controlling device 5 can be exemplified by a control panel in which a function portion (operation button or lever, keyboard, or the like) for entering the user's operation, and a function portion for outputting an instruction to a monitor and combustion controlling devices 1A and 1B are integrated together. For example, when a network controlling system in which the combustion controlling device 1, the monitor, and a central management device are connected to each other through a network is structured, the function portion for giving the instruction to the combustion controlling device 1 can configure the controlling device 5 as in the central management device.

As described above, the combustion controlling device 1 controls the combustion of the respective burners 22A to 22C in the combustion chamber 2 according to the combustion request, the combustion stop request, or the like from the controlling device 5. Hereinafter, a specific configuration of the combustion controlling device 1 will be described.

(Configuration of Combustion Controlling Device)

As illustrated in FIG. 1, the combustion controlling device 1 includes the safety controlling device 10 and the burner controllers 11A to 11C (collectively referred to as "burner controllers 11").

The safety controlling device 10 is a device that performs the safe operation of the combustion system 500, in other words, monitors combustion states of the respective burners and states of the respective limit interlocks (not shown) in order to prevent the explosion in the combustion chamber 2, to thereby perform the safety control for instructing the respective burner controllers to allow or disallow the operation of the respective burners in the combustion chamber.

The safety controlling device 10 can be exemplified by a limit interlock module for monitoring a limit interlock manufactured on the basis of safety rules (for example, safety general rules of the industrial combustion furnace JIS B 8415, etc.) related to the industrial combustion furnaces, or a programmable logic controller (so-called safety PLC) that configures a dedicated software complying with the safety general rules.

Specifically, the safety controlling device 10 outputs various instructions related to the combustion control of the respective burners to the respective burner controllers 11A to 11C on the basis of the combustion request or the combustion stop request of the burners from the controlling device 5, or the flame determination information input from the respective burner controllers 11A to 11C.

For example, as the operation in igniting the burners, when M (integer of $1 \leq M \leq N$) number of burners 22 are ignited from a state in which none of N number of burners 22 is ignited, the safety controlling device 10 instructs the respective burner controllers 11A to 11C to purge the combustion spaces 21A to 21C, and instructs the respective burner controllers 11 to ignite the M number of burners 22 after the purge has been completed. On the other hand, when the burners are ignited in an operating state (hereinafter referred to as "normal operating state") after the M number of burners are normally ignited, the safety controlling device 10 instructs the burner controllers 11 to ignite the burners 22 without giving an instruction to purge the combustion spaces 21.

The burner controllers 11A to 11C are devices that are disposed in the respective burners, and control the ignition of the respective burners and the purge of the combustion spaces of the respective burners. Specifically, when the burner controllers 11 are instructed to execute the purge of the combustion spaces 21 from the safety controlling device 10, the burner controllers 11 controls the respective air valves 41, to thereby purge the instructed combustion spaces 21.

When the burner controllers 11 are instructed to ignite the burners 22 from the safety controlling device 10, the burner controllers 11 ignite the respective burners according to a predetermined ignition sequence under control. In the combustion controlling device (burner controllers 11) according to the present embodiment, an execution time of the purge to be executed according to the ignition sequence can be set to times different between the initial start time and the normal operating state.

Hereinafter, the control based on the ignition sequence will be described in detail.

(Control Based on Ignition Sequence)

Figure 2:
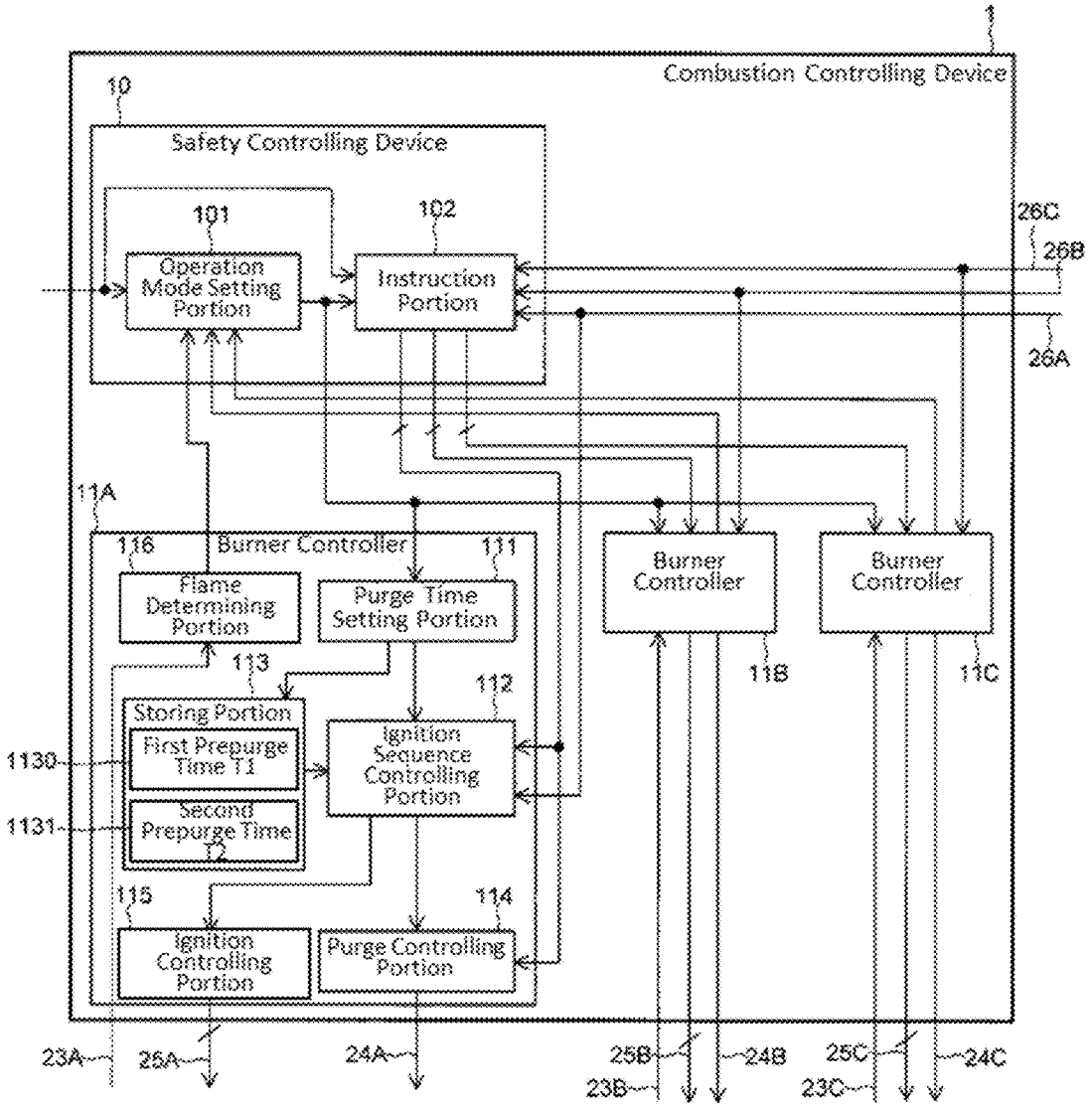
FIG. 2 is a diagram illustrating a configuration of a combustion controlling device according to the embodiment.

FIG. 2 is a diagram illustrating a configuration of the combustion controlling device 1 according to the embodiment.

In the drawing, only the function portions associated with the control based on the ignition sequence by the burner controllers 11 are illustrated in the combustion controlling device 1 (the safety controlling device 10 and the burner controllers 11), and the other function portions (for example, function portions for monitoring a limit or an interlock, etc.) are omitted from illustration.

Although not shown, the safety controlling device 10 and the burner controllers 11 are equipped with external terminals for transmitting and receiving signals with respect to the external devices (the safety shutoff valves 31, the air valves 41, etc.), and external interfaces such as an input circuit and an output circuit.

(1) Safety Controlling Device 10

As illustrated in FIG. 2, the safety controlling device 10 includes an operation mode setting portion 101 and an instruction portion 102 as the function portions associated with the control based on the above ignition sequence. For example, those function portions are realized by a processor such as a CPU, various memories, and a microcontroller (MCU) configured by the other peripheral circuits. In other words, the processor in the MCU executes a variety of data processing according to a program stored in the memory to realize the operation mode setting portion 101 and the instruction portion 102.

The operation mode setting portion 101 is a function portion that sets the operation mode of the burners 22 in the combustion chamber 2. Specifically, the operation mode setting portion 101 sets any one of the initial startup mode and the normal operation mode as the operation mode on the basis of the flame determination information supplied from the respective burner controllers 11A to 11C or the combustion request and the stop request from the controlling device 5.

In the present specification, the initial startup mode means an operation mode for igniting the M number of burners from a state in which none of the N number of burners 22 is ignited. The normal operation mode means an operation mode for controlling the operation of the N number of burners 22 in the normal operating state.

The M number of burners means burners to be ignited during the initial startup, which are, for example, a first burner to be initially ignited in the case of a sequential startup to be described later ($M=1$), and all of the burners to be ignited at the same time in the case of a simultaneous startup to be described later ($M \geq 2$).

For example, the operation mode setting portion 101 sets the operation mode to "the initial startup mode" when none of the burners 22 is ignited. For example, the operation mode setting portion 101 sets the operation mode to "initial startup mode" during the initial operation immediately after the combustion system 500 has started, in the case where the combustion request for all of the burners 22 from the controlling device 5 is absent, and in the case where all of the burners 22 in the combustion chamber 2 are locked out (or the lockout is canceled (reset)).

On the other hand, the operation mode setting portion 101 switches the operation mode from "the initial startup mode"

to "the normal operation mode" when the M number of burners are normally ignited in the initial startup mode (when all of the burners to be ignited simultaneously are ignited in the simultaneous startup which will be described later, or when a burner first subjected to the combustion request is ignited in the sequential startup which will be described later). Specifically, the operation mode setting portion 101 switches the operation mode from "the initial startup mode" to "the normal operation mode" when the flame determination information from a flame determining portion 116, which will be described later, corresponding to the burner 22 whose ignition is instructed indicates "that stable flame is generated" in the initial startup mode.

The instruction portion 102 instructs the respective burner controllers 11A to 11C to allow or disallow the operation of the burners 22A to 22C, and also to execute the purge of the respective combustion spaces 21A to 21C.

Specifically, when the instruction portion 102 receives an instruction for igniting the burners 22 from the controlling device 5 in the initial startup mode, the instruction portion 102 first gives an instruction on the execution of the overall purge. For example, the instruction portion 102 instructs the respective burner controllers 11A to 11C to execute the purge of the combustion spaces 21A to 21C. Information on a period (overall prepurge time) T0 (T0>0) during which the overall purge is executed is stored in a storing portion (not shown) of the safety controlling device 10 in advance, and the instruction portion 102 outputs an execution instruction for the overall purge on the basis of the information stored in the storing portion. After the overall prepurge time T0 has elapsed, the instruction portion 102 outputs an ignition instruction for the burners 22 whose ignition is instructed from the controlling device 5 to the respective burner controllers 11.

On the other hand, when the instruction portion 102 receives the instruction for igniting a specific burner 22 from the controlling device 5 in the normal operation mode, the instruction portion 102 outputs the ignition instruction for the specific burner 22 which is given from the controlling device 5 to the corresponding burner controller 11 without giving an instruction on the execution of the overall purge.

(2) Burner Controllers 11

As illustrated in FIG. 2, the burner controllers 11 has a purge time setting portion 111, an ignition sequence controlling portion 112, a storing portion 113, a purge controlling portion 114, an ignition controlling portion 115, and the flame determining portion 116 as the function portions associated with the control based on the ignition sequence. For example, those function portions are realized by a processor such as a CPU, various memories, and a microcontroller (MCU) configured by the other peripheral circuits. In other words, the processor in the MCU executes a variety of data processing according to the program stored in the memory, to thereby realize the purge time setting portion 111, the ignition sequence controlling portion 112, the storing portion 113, the purge controlling portion 114, the ignition controlling portion 115, and the flame determining portion 116.

Meanwhile, since the respective burner controllers 11A to 11C have the same configuration, the burner controller 11A will be typically described below, and a detailed description of the other burner controllers 11B and 11C will be omitted.

The purge time setting portion 111 is a function portion for setting the execution time of the prepurge to be executed according to the ignition sequence, that is, the single purge on the basis of the operation mode set by the operation mode setting portion 101. Specifically, the purge time setting portion 111 sets the execution time of the single purge to a first prepurge time T1 when the initial startup mode is set by the operation mode setting portion 101, and sets the execution time of the single purge to a second prepurge time T2 when the normal operation mode is set by the operation mode setting portion 101.

Information 1130 on the first prepurge time T1 and information 1131 on the second prepurge time T2 are written, for example, in a nonvolatile memory such as an internal flash memory in the production or during shipment of the combustion controlling device 1 (the safety controlling device 10 or the burner controller 11), and expanded in a RAM in the MPU of the burner controller 11 from the nonvolatile memory, to thereby be stored in the storing portion 113 at the startup of the combustion controlling device 1.

The purge time setting portion 111 reads information of the prepurge time corresponding to the operation mode selected by the operation mode setting portion 101 from the storing portion 113, to thereby set the execution time of the single purge.

The first prepurge time T1 and the second prepurge time T2 can be arbitrarily set according to the type of the combustion system 500 or a request of the user who uses the combustion system 500. In the present embodiment, as an example, T1=0 [s] and T2=T0 are set.

The ignition sequence controlling portion 112 is a function portion for instructing the purge controlling portion 114 and the ignition controlling portion 115 to control the ignition operation of a corresponding burner according to a predetermined ignition sequence.

The predetermined ignition sequence is a program that defines a procedure of the monitoring of each limit and interlock, the execution of the prepurge, and the execution of the ignition operation (ignition trial) in igniting the burner. The information on the predetermined ignition sequence is stored, for example, in a storing portion (not shown) in each of the burner controllers 11. For example, when the ignition instruction is input from the instruction portion 102 to the burner controller 11, the program stored in the storing portion is executed, and the ignition sequence controlling portion 112 instructs the purge controlling portion 114 and the ignition controlling portion 115 to ignite the burner in a predetermined procedure according to the program.

Specifically, when the ignition sequence controlling portion 112 receives the ignition instruction for the burner 22 from the instruction portion 102, the ignition sequence controlling portion 112 instructs the purge controlling portion 114 to execute the prepurge based on the execution time of the single purge which is set by the purge time setting portion 111, and also instructs the ignition controlling portion 115 to ignite the burner 22.

For example, in the case where the ignition sequence controlling portion 112 receives the ignition instruction for the burner 22 from the instruction portion 102 in the initial startup mode, that is, when the execution time of the single purge is set to the first prepurge time T1 by the purge time setting portion 111, the ignition sequence controlling portion 112 instructs the purge controlling portion 114 to supply air to the combustion space of the corresponding burner in a state where the supply of fuel stops. The ignition sequence controlling portion 112 instructs the ignition controlling portion 115 to start the ignition operation of the corresponding burner after the first prepurge time T1 has elapsed. In this situation, if T1=0 is met, the ignition sequence controlling portion 112 instructs the ignition controlling portion 115 to ignite the burner 22 with allowing the purge controlling portion 114 to execute the prepurge for 0 seconds, in other words, without allowing the purge controlling portion 114 to execute the prepurge.

In the case where the ignition sequence controlling portion 112 receives the ignition instruction for the burner 22 from the instruction portion 102 when the execution time of the single purge is set to the second prepurge time T2 by the purge time setting portion 111 in the normal operation mode, the ignition sequence controlling portion 112 instructs the purge controlling portion 114 to supply the air to the combustion space of the corresponding burner in a state where the supply of fuel stops. Then, the ignition sequence controlling portion 112 instructs the ignition controlling portion 115 to start the ignition operation of the corresponding burner after the second prepurge time T2 has elapsed.

The purge controlling portion 114 is a function portion that controls the purge of the corresponding combustion space 21 according to an instruction for execution of the purge from the instruction portion 102 and the ignition sequence controlling portion 112. Specifically, when the purge controlling portion 114 is instructed to execute the purge of the combustion space 21 from the instruction portion 102 or the ignition sequence controlling portion 112, the purge controlling portion 114 outputs the control signal 24, to thereby open the air valve 41 corresponding to the instructed combustion space 21 and start the purge of the combustion space. When the purge controlling portion 114 is instructed to stop the purge of the combustion space 21 from the instruction portion 102 or the ignition sequence controlling portion 112, the purge controlling portion 114 outputs the control signal 24, to thereby close the air valve 41 corresponding to the instructed combustion space 21, and stop the purge of the combustion space.

The ignition controlling portion 115 is a function portion that controls the ignition of the corresponding burner 22 and the combustion stop of the corresponding burner according to an instruction from the instruction portion 102 and an ignition instruction from the ignition sequence controlling portion 112. Specifically, the ignition controlling portion 115 includes a function portion for controlling the open/close operation of the safety shutoff valve 31, and a function portion for controlling the ignition device (not shown), and output control signals from the respective function portions to drive a device to be controlled. In the present embodiment, the respective control signals output from the function portions in the ignition controlling portion 115 are collectively referred to as "control signals 25".

When the ignition controlling portion 115 is instructed to ignite from the ignition sequence controlling portion 112, the ignition controlling portion 115 outputs the control signal 25, to thereby open the safety shutoff valve 31 corresponding to the burner 22 instructed to ignite, and generate spark by the ignition device (not shown) to ignite the burner 22. On the other hand, when ignition controlling portion 115 is instructed to stop the combustion of the burner from the ignition sequence controlling portion 112 or the instruction portion 102, the ignition controlling portion 115 outputs the control signal 25, to thereby close the corresponding safety shutoff valve 31 and stop the combustion of the burner.

The flame determining portion 116 generates the flame determination information indicating whether stable flame is generated from the burner 22, or not, on the basis of a flame detection signal 23 output from the flame detector (not shown) of the corresponding burner 22. The flame determination information is used for determination of the switching of the operation mode by the above-mentioned operation mode setting portion 101, and also used for determination of the execution of the lockout of the corresponding burner by the burner controller 11.

Subsequently, the ignition operation of the burner 22 by the function portion associated with the control based on the above-mentioned ignition sequence will be described in detail with reference to timing charts of FIGS. 3 and 4.

In general, in the multi-burner system like the combustion system 500, two types of techniques including "sequential startup" for sequentially igniting the respective burners in the combustion chamber and "simultaneous startup" for igniting the respective burners in the combustion chamber, simultaneously, have been known as ignition techniques during the initial startup. As an example, the ignition operation of the burner 22 in the above respective ignition techniques will be described.

In the following description, as described above, it is assumed that the overall prepurge time T0>0, the first prepurge time T1=0, and the second prepurge time T2=T0 are set in the combustion controlling device 1.

First, the ignition operation of the burner during the sequential startup will be described. FIG. 3 is a timing chart for illustrating the ignition operation of the burner during the sequential startup by the combustion controlling device according to the embodiment.

Figure 3:
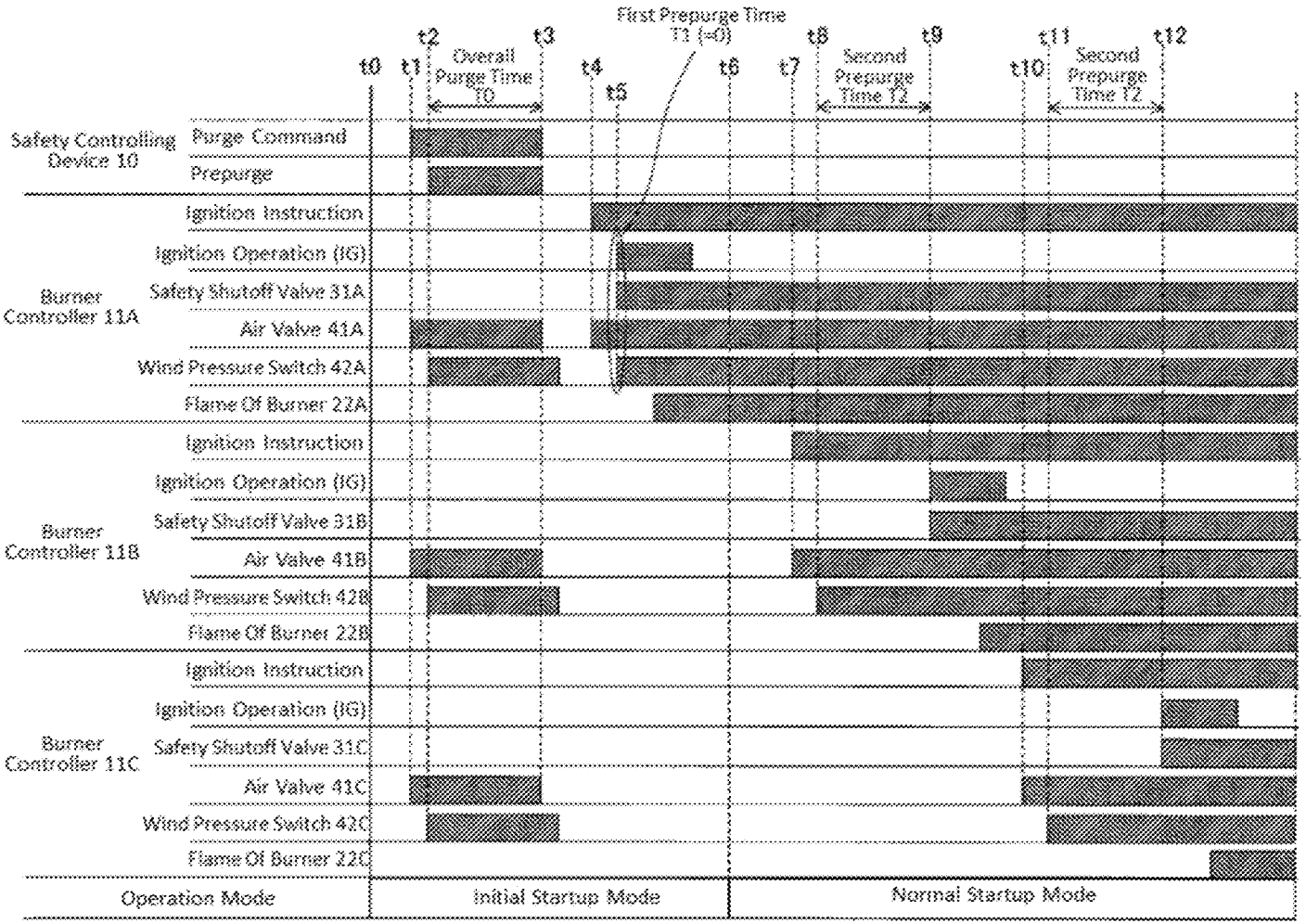
FIG. 3 is a timing chart for illustrating ignition operation of burners during a sequential startup by the combustion controlling device according to the embodiment.

A top stage of FIG. 3 indicates whether the instruction of purge (purge command) by the safety controlling device 10 is present, or not, and a period of the overall prepurge. The lower stages of FIG. 3 indicate whether the ignition request (combustion request) for the burners is present, or not, whether the ignition operation (ignition trial) is present, or not, the open or closed state of the safety shutoff valves 31, the open or closed state of the air valves 41, a detection state of the wind pressure switch 42, and whether the flame of the burners 22 is present, or not, in the stated order of the burner controllers 11A, 11B, and 11C. A bottom of FIG. 3 indicates the operation modes.

In FIG. 3, a period during which the combustion request is output, an ignition period (ignition trial period) during which the ignition operation is performed, a period during which each safety shutoff valve 31 is opened, a period during which each air valve 41 is opened, a period in which each wind pressure switch 42 detects a certain or more pressure, and a period during which the flame is generated are hatched. Those various pieces of information in FIG. 3 are the same as that in FIG. 4 which will be described later.

As illustrated in FIG. 3, for example, at a time t0, when the combustion system 500 starts, the operation mode setting portion 101 selects "the initial startup mode", and the purge time setting portion 111 sets the first prepurge time T1 (=0) as the execution time of the single purge in response to the selection.

Thereafter, the controlling device 5 outputs the combustion request for the combustion chamber 2 to the combustion controlling device 1 according to a sequence of the sequential startup. Specifically, the controlling device 5 outputs the combustion request for a burner to be first ignited in the sequence of the sequential startup, for example, the burner 22A to the combustion controlling device. The combustion controlling device 1 that has received the combustion request first executes the overall purge. Specifically, for example, at a time t1, the instruction portion 102 of the safety controlling device 10 instructs the respective burner controllers 11A to 11C to execute the prepurge of the respective combustion spaces 21A to 21C. The respective burner controllers 11A to 11C that have received the instruction start the prepurge of the combustion spaces 21A to 21C by the purge controlling portion 114.

After the prepurge starts, for example, at a time t2, when the detection signals 26A to 26C indicating that the certain or more pressure is detected have been output from the respective wind pressure switches 42A to 42C, the safety controlling device 10 starts to count the purge time. Then, for example, at a time t3, if the count time matches the overall purge time T0, the instruction portion 102 of the safety controlling device 10 instructs the respective burner controllers 11A to 11C to stop the purge, to thereby complete the overall purge.

At a time t4 immediately after the overall purge has been completed, the instruction portion 102 of the safety controlling device 10 outputs the ignition instruction of the burner 22A to the burner controller 11A. The burner controller 11A that has received the ignition instruction starts the ignition operation according to the ignition sequence.

First, the ignition sequence controlling portion 112 instructs the purge controlling portion 114 to open the air valve 41A. Since the execution time of the single purge is set to the first prepurge time T1 (=0), after the detection signal 26A indicating that the certain or more pressure is detected has been output from the wind pressure switch 42A, for example, at a time t5, the ignition sequence controlling portion 112 instructs the ignition controlling portion 115 to ignite the corresponding burner without counting the purge time. The ignition controlling portion 115 that has received the instruction opens the safety shutoff valve 31A to supply the fuel to the burner 22A, and also starts the ignition trial. As a result, the burner 22A is ignited.

After the ignition period of the burner 22A has elapsed, for example, at a time t6, the flame determining portion 116 of the burner controller 11A outputs the flame determination information indicating that the stable flame is generated to the safety controlling device 10. The safety controlling device 10 that has received the flame determination information switches the operation mode from "the initial startup mode" to "the normal operation mode" by the operation mode setting portion 101. In response to the switched normal operation mode, the purge time setting portions 111 of the respective burner controllers 11A to 11C change the execution time of the single purge from "the first prepurge time T1" to "the second prepurge time T2".

At a time t7 after switching the operation mode to the normal operation mode, when the controlling device 5 outputs the ignition instruction for a burner to be next ignited in the sequence of the sequential startup, for example, the burner 22B to the combustion controlling device 1, the safety controlling device 10 outputs the ignition instruction for the burner 22B to the burner controller 11B. The burner controller 11B that has received the ignition instruction starts the ignition operation according to the ignition sequence.

As described above, since the execution time of the single purge changes from the first prepurge time T1 to the second prepurge time T2, the ignition sequence controlling portion 112 of the burner controller 11B first instructs the purge controlling portion 114 to open the air valve 41A, to thereby start the prepurge of the combustion space 21B. Thereafter, for example, at a time t8, when the detection signal 26B indicating that the certain or more pressure is detected have been output from the wind pressure switch 42B, the ignition sequence controlling portion 112 starts to count the purge time. Then, for example, at a time t9, if the count time matches the second prepurge time T2, the ignition sequence controlling portion 112 instructs the purge controlling portion 114 to stop the purge, to thereby complete the single purge of the combustion space 21B.

After the completion of the single purge in the combustion space 21B, the ignition sequence controlling portion 112 in the burner controller 11B instructs the ignition controlling portion 115 to ignite the burner 22B. The ignition controlling portion 115 that has received the instruction opens the safety shutoff valve 31B to supply the fuel to the burner 22B, and also starts the ignition trial. As a result, the burner 22B is ignited.

Thereafter, for example, at a time t10, when the controlling device 5 outputs the ignition instruction for a burner to be finally ignited in the sequence of the sequential startup, in other words, the burner 22C to the combustion controlling device 1, the safety controlling device 10 outputs the ignition instruction for the burner 22C to the burner controller 11C. The burner controller 11C that has received the ignition instruction performs the ignition operation according to the ignition sequence as with the burner controller 11B described above. In other words, the burner controller 11C ignites the burner 22C after performing the single purge in the second prepurge time T2. As a result, all of the burners 22A to 22C are ignited.

Next, the ignition operation of the burner during the simultaneous startup will be described.

Figure 4:
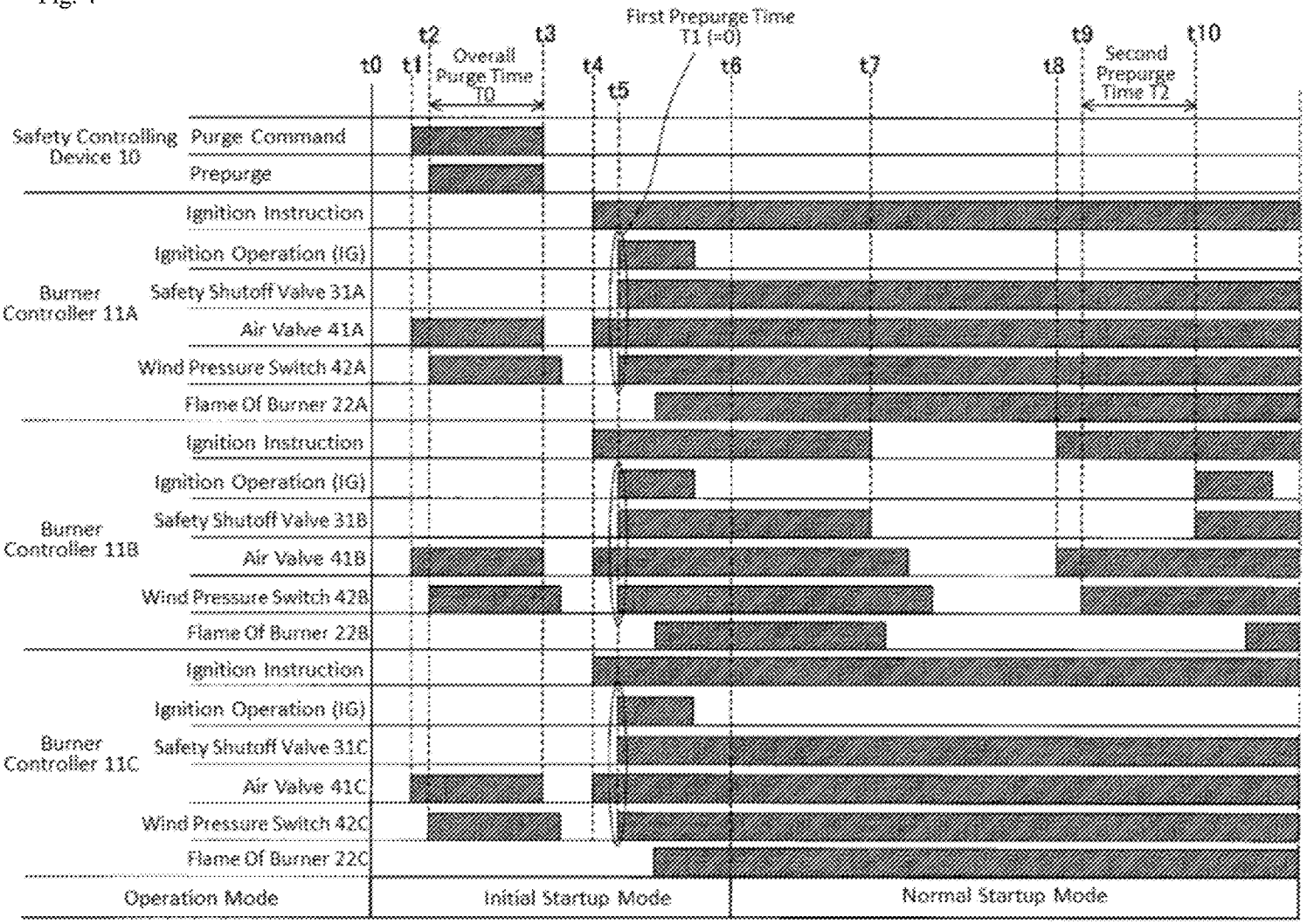
FIG. 4 is a timing chart for illustrating the ignition operation of burners during a simultaneous startup by the combustion controlling device according to the embodiment.

FIG. 4 is a timing chart for illustrating the ignition operation of burners during the simultaneous startup by the combustion controlling device according to the embodiment.

As illustrated in FIG. 4, for example, at a time t0, when the combustion system 500 starts, the operation mode setting portion 101 selects "the initial startup mode", and the purge time setting portion 111 sets the first prepurge time T1 (=0) as the execution time of the single purge in response to the selection.

Thereafter, the controlling device 5 outputs the combustion request for the combustion chamber 2 to the combustion controlling device 1 according to a sequence of the simultaneous startup. Specifically, the controlling device 5 outputs the combustion request for all of the burners to be ignited in the sequence of the simultaneous startup, in other words, the burners 22A to 22C to the combustion controlling device 1. The combustion controlling device 1 that has received the combustion request executes the overall purge, for example, at the time t1. A specific processing procedure in the overall purge is the same as that described in FIG. 3.

Upon the completion of the overall purge at the time t3, at the time t4 immediately after the overall purge has been completed, the instruction portion 102 of the safety controlling device 10 outputs the ignition instruction of the burners 22A to 22C to the respective burner controllers 11A to 11C. The respective burner controllers 11A to 11C that have received the ignition instruction start the ignition operation according to the ignition sequence.

Specifically, the ignition sequence controlling portions 112 in the respective burner controllers 11A to 11C instruct the respective purge controlling portions 114 to open the air valves 41A to 41C. Since the execution time of the single purge is set to the first prepurge time T1 (=0), after the detection signals 26A to 26C indicating that the certain or more pressure is detected has been output from the respective wind pressure switches 42A to 42C, for example, at the time t5, the ignition sequence controlling portions 112 in the respective burner controllers 11A to 11C instruct the ignition controlling portions 115 to ignite the respective burners without counting the purge time. The ignition controlling portions 115 that have received the instruction opens the respective safety shutoff valves 31A to 31C to supply the fuel to the burners 22A to 22C, and also start the ignition trial. As a result, the burners 22A to 22C are ignited.

After the burners 22A to 22C have been ignited, for example, at the time t6, the flame determining portions 116 in the respective burner controllers 11A to 11C output the flame determination information indicating that the stable flame is generated to the safety controlling device 10. The safety controlling device 10 that has received the flame determination information determines that all of the burners 22A to 22C to be ignited simultaneously in the initial startup mode have been normally ignited, and switches the operation mode from "the initial startup mode" to "the normal operation mode" by the operation mode setting portion 101. In response to the switched normal operation mode, the purge time setting portions 111 of the respective burner controllers 11A to 11C change the execution time of the single purge from "the first prepurge time T1" to "the second prepurge time T2".

Thereafter, the burner 22B is subjected to flame failure, for example, at a time t7, and the reignition of the burner 22B is again required by the controlling device 5 at a time t8. In that case, the instruction portion 102 of the safety controlling device 10 instructs the burner controller 11B to ignite the burner 22B.

In that case, as described above, since the execution time of the single purge changes from the first prepurge time T1 to the second prepurge time T2, the ignition sequence controlling portion 112 of the burner controller 11B first instructs the purge controlling portion 114 to open the air valve, to thereby start the prepurge of the combustion space 21B. Thereafter, for example, at a time t9, when the detection signal 26B indicating that the certain or more pressure is detected have been output from the wind pressure switch 42B, the ignition sequence controlling portion 112 starts to count the purge time. Then, for example, at a time t10, if the count time matches the second prepurge time T2, the ignition sequence controlling portion 112 instructs the purge controlling portion 114 to stop the purge, to thereby complete the single purge of the combustion space 21B.

After the completion of the single purge in the combustion space 21B, the ignition sequence controlling portion 112 in the burner controller 11B instructs the ignition controlling portion 115 to ignite the burner 22B. The ignition controlling portion 115 that has received the instruction opens the safety shutoff valve 31B to supply the fuel to the burner 22B, and also starts the ignition trial. As a result, the burner 22B is again ignited.

(Advantages of Combustion Controlling Device)

As described above, according to the combustion controlling device of the present invention, as the execution times of the single purge in the respective combustion spaces in igniting the burners, the single purge time (first prepurge time T1) during the initial startup and the single purge time (second prepurge time T2) during the normal operation can be set, individually. As a result, since the execution times of the single purge can be different between the case in which the burners are ignited during the initial startup and the case in which the burners are ignited during the normal operation, the overall purge time in igniting the burners during the initial startup can be optimized.

Specifically, as described above, the first prepurge time T1 is set to be shorter than the second prepurge time T2 with the results that appropriate prepurge times of the respective burners are ensured during the reignition in the normal operating state while a total purge time of a time required for the overall purge and a time required for the single purge is reduced during the initial startup, and a time until the burners are ignited can be reduced.

In particular, the execution time of the single purge during the initial startup is set to 0 seconds, thereby being capable of omitting the single purge during the initial startup. According to this configuration, even if the single purge during the initial startup is omitted, since the overall purge is executed during the initial startup, an appropriate purge time can be ensured, and a time until the burners are ignited can be further reduced.

The invention made by the present inventors has been described above on the basis of the embodiments in detail. However, the present invention is not limited to the embodiments, but can be variously changed without departing from a spirit of the invention.

For example, in the above embodiment, the example in which the combustion system 500 has one combustion chamber 2 has been described. The number of combustion chambers is not particularly restricted. For example, the combustion system 500 may have multiple combustion chambers. In that case, the combustion controlling device 1 may be installed in each of the combustion chambers, and the combustion of the burners 22 placed in the respective combustion chambers may be controlled by the respective combustion controlling devices 1. The respective combustion chambers may have a structure in which a part of walls of the adjacent combustion chambers is opened, for example, so that a workpiece can move between the combustion chambers through a belt conveyer. In other words, the respective combustion chambers may be configured by spaces in which a temperature, a pressure or the like can be controlled, individually, regardless of whether those combustion chambers are physically separated from each other, or not.

In the above embodiment, the information 1130 on the first prepurge time T1 and the information 1131 on the second prepurge time T2 are written in the nonvolatile memory or the like such as the flash memory in the production or during shipment of the combustion controlling device 1. Alternatively, the information 1130 on the first prepurge time T1 and the information 1131 on the second prepurge time T2 may be rewritten even after the production of the combustion controlling device 1, for example, during the construction of the combustion system 500 or during the maintenance of the combustion system 500.

In the above embodiment, the wind pressure switches 42A to 42C are exemplified. However, a device in which the supply of air to the combustion spaces can be confirmed is not limited to the above configuration. For example, the wind pressure switches 42A to 42C may be replaced with a differential pressure sensor or a flow rate sensor.

DESCRIPTION OF REFERENCE NUMERALS AND SIGNS

1 . . . combustion controlling device, 2 . . . combustion chamber, 3 . . . fuel flow channel, 4 . . . air flow channel, 5 . . . controlling device, 10 . . . safety controlling device, 11A to 11C . . . burner controller, 20 . . . heating space, 21A to 21C . . . combustion space, 22A to 22C . . . burner, 23A to 23C . . . flame detection signal, 24A to 24C and 25A to 25C . . . control signal, 26A to 26C . . . detection signal, 30 and 31A to 31C . . . safety shutoff valve, 40 . . . blower, 41A to 41C . . . air valve, 42A to 42C . . . wind pressure switch 42, 101 . . . operation mode setting portion, 102 . . . instruction portion, 111 . . . purge time setting portion, 112 . . . ignition sequence controlling portion, 113 . . . storing portion, 1130 . . . information on first prepurge time T1, 1131 . . . information on second prepurge time T2, 114 . . . purge controlling portion, 115 . . . ignition controlling portion, and 116 . . . flame determining portion.

The invention claimed is:

1. A combustion controlling device that controls operations of N, N being an integer of 2 or more, number of burners having respective combustion spaces different from each other in a multi-burner apparatus comprising a combustion chamber that physically separates a flame in each of the respective combustion spaces from a heating space in which an object to be heated is placed, the combustion controlling device comprising:

burner controllers that are disposed for the respective N number of burners, and that control an ignition of each of the respective N number of burners and a purge of each of the combustion spaces of the respective N number of burners;

an instruction portion that instructs the burner controllers to execute the purge of the respective combustion spaces and to ignite the respective N number of burners; and an operation mode setting portion that sets an operation mode of the combustion controlling device to one of an initial startup mode and a normal operation mode, wherein in the initial startup mode, the instruction portion instructs the burner controllers to purge the respective combustion spaces all at once as an overall purge and to ignite M, M being an integer between 1 and N, number of the burners after the overall purge has been completed from a state in which none of the N number of burners is ignited, in the normal operation mode, the instruction portion instructs one of the burner controllers to ignite one of the N number of burners without giving an instruction for the overall purge after the M number of burners have been normally ignited, and each of the burner controllers comprises:

a purge controlling portion that controls the purge of the combustion space of the corresponding burner according to instructions from the instruction portion;

an ignition controlling portion that controls the ignition of the corresponding burner;

a storing portion that stores a second prepurge time and a first prepurge time that is less than the second prepurge time;

a purge time setting portion that sets a prepurge execution time to a first prepurge time when the initial startup mode is set by the operation mode setting portion, and sets the prepurge execution time to the second prepurge time when the normal operation mode is set by the operation mode setting portion; and an ignition sequence controlling portion that instructs the purge controlling portion to execute a prepurge of the combustion space of the corresponding burner based on the prepurge execution time set by the purge time setting portion, and instructs the corresponding ignition controlling portion to ignite the corresponding burner, according to an instruction for igniting the corresponding burner by the instruction portion.

2. The combustion controlling device according to claim 1, wherein the first prepurge time is 0 seconds.

3. The combustion controlling device according to claim 1, wherein the operation mode setting portion switches the operation mode from the initial startup mode to the normal operation mode when the M number of burners are normally ignited in the initial startup mode.

4. A combustion system comprising:

the combustion controlling device according to any one of claims 1, 2, and 3;

the combustion chamber having the N number of combustion spaces;

first valves that are disposed in the respective combustion spaces, and control a supply of air to the respective combustion spaces based on a control signal from the purge controlling portion; and second valves that are disposed in the respective combustion spaces, and control a supply of fuel to the burners of the respective combustion spaces based on of a control signal from the ignition controlling portion.

5. The combustion system according to claim 4 wherein the burners are radiant tube burners.

* * * * *